United States Patent [19]

Aylett

[11] 3,960,077

[45] June 1, 1976

[54] PRINTING WITH BLANKET HAVING RECESSED PORTION

[75] Inventor: Frank Henry Aylett, Otley, England

[73] Assignee: Vickers Limited, London, England

[22] Filed: Nov. 26, 1974

[21] Appl. No.: 527,484

[30] Foreign Application Priority Data

Nov. 29, 1973 United Kingdom ..... 55519/73

[52] U.S. Cl. ..... 101/142; 101/350; 356/212

[51] Int. Cl.[2] ..... B41F 9/00

[58] Field of Search ..... 101/142, 348, 350; 250/225; 356/209, 212

[56] References Cited

UNITED STATES PATENTS

| | | | |
|---|---|---|---|
| 2,360,340 | 10/1944 | Harris | 101/142 |
| 2,578,625 | 12/1951 | Bowers et al. | 356/212 X |
| 3,234,871 | 2/1966 | Ostwald | 101/142 |
| 3,439,175 | 4/1969 | Kammuller et al. | 250/214 R X |

FOREIGN PATENTS OR APPLICATIONS

| | | | |
|---|---|---|---|
| 282,748 | 8/1952 | Switzerland | 101/348 |

*Primary Examiner*—Harland S. Skogquist
*Attorney, Agent, or Firm*—Nichol M. Sandoe

[57] ABSTRACT

In an offset lithographic printing machine a recess is provided in the offset blanket in a position such that when the recess is at the nip between the blanket cylinder and the printing plate cylinder the recess is in registry with a part of the non-printing area of the printing plate. The amount of water on that part of the non-printing area is then determined as, for example, a function of the amount of radiation reflected by that part.

13 Claims, 4 Drawing Figures

PRINTING WITH BLANKET HAVING RECESSED PORTION

This invention relates to the detection of water on lithograhic printing surfaces in printing processes.

According to one aspect of the present invention there is provided a method of determining the amount of water present on the surface of a printing plate carried by a plate cylinder during offset lithographic printing, which method comprises:

a. applying water to the non-printing area of the printing plate,
b. applying ink to the printing area of the printing plate,
c. transferring ink from the printing area to an offset blanket which is carried by a blanket cylinder and which includes a recessed portion on its surface, said recessed portion being arranged to be in registry with a part of the non-printing area of the printing plate when at the nip between the plate cylinder and the blanket cylinder,
d. transferring ink from the blanket to a receiving member to be printed, and
e. determining the amount of water present on a monitoring zone which is constituted by said part of the non-printing area.

According to another aspect of the present invention there is provided an offset lithographic printing machine which comprises:

i. a plate cylinder carrying a printing plate including printing and non-printing areas,
ii. a means of applying water to the non-printing area,
iii. a means of applying ink to the printing area,
iv. a blanket cylinder carrying an offset blanket which includes a recessed portion in its surface and which is arranged to receive ink from the printing area and transfer the same to a receiving member to be printed, said recessed portion of the blanket being arranged to be in registry with a part of the non-printing area when at the nip between the blanket cylinder and the plate cylinder, and
v. a damp measuring device arranged to determine the amount of water present on a monitoring zone which is constituted by said part of the non-printing area.

In a particularly preferred embodiment, the amount of water present on the monitoring zone is determined as a function of the amount of radiation reflected by the zone.

This may be effected by directing radiation from a source to a detector by way of a standard medium which determines the proportion of said radiation reaching the detector to produce a first signal representing the amount of said radiation reaching said detector by way of the standard medium, directing radiation from said source at a given angle of incidence onto the monitoring zone so that radiation is reflected by said zone to said detector to produce a second signal representiing the amount of radiation reflected from the zone, and making a comparison of the first and second signals to obtain a measure of the amount of water present on said zone. In this case, the damp measuring device will comprise a means of directing radiation at a given angle of incidence onto the monitoring zone and a means of detecting the amount of radiation reflected by said zone in a particular direction to provide a signal which represents the amount of water present on said zone. The amount of radiation reflected may depend on the degree to which the incident radiation is absorbed by the damp zone or the degree to which the incident radiation is scattered by the damp zone. In the latter case, the principle of damp measurement depends upon the fact that, at low angles of incidence, any water (by which term we include all fountain solutions) on the plate enhances the reflectivity of the plate by reducing the amount of scatter. Even when the plate is dry, a certain minimum reflectance will occur and hence the damp measuring device will produce a certain minimum signal. This gives rise to an apparent damp level. The apparent damp level depends upon the surface smoothness of the plate and hence as the plate wears and becomes smoother and more reflective the apparent damp level will increase. Thus, an accurate measure of the amount of damp present will not be obtained after printing has been effected for a sufficient period to cause wear of the surface on which the determination is being made. Further, under closed loop conditions (i.e. where the amount of water present as indicated by the damp measuring device is used to control the amount of water subsequently applied), the real level of damp will become reduced resulting eventually in ink catch up. Most of the wear of the printing plate is caused by contact of the plate with the blanket of the blanket cylinder. In accordance with the present invention, the monitoring zone in which the damp measurement is effected is not contacted by the blanket. Consequently, the monitoring zone is subjected to less wear than is the remainder of the printing plate surface and hence the apparent damp level of the monitoring zone is more constant during a given printing run.

The present invention is particularly useful in conjunction with web fed printing machines but may be used with sheet fed machines and, indeed, with any offset lithographic machine.

Offset blankets generally comprise a layer of rubber provided with a canvas backing and in one embodiment the recessed portion of the blanket is produced by punching a hole through the blanket. In another embodiment, the recessed portion is in the form of a depression formed by locally compressing the blanket to an extent such that the elastic limit is exceeded so as to put a permanent set in the blanket. This can be effected by subjecting the appropriate part of the blanket to an impact force of such a magnitude that said part is permanently depressed and does not recover elastically. In a further embodiment the recessed portion is in the form of a pocket gouged in the surface of the blanket. In the latter case, it is preferred for the pocket not to extend to the canvas backing. In the case where the recessed portion is produced in a manner such that damper fluids, washing-up fluids, blanket reviver or the like have access to the canvas backing and hence could cause localised swelling, it is preferred to treat the recessed portion with a suitable sealant e.g. based on silicone resin to restrict penetration of such fluids into the canvas. If the blanket cylinder is provided with two blankets, the recessed portion may be formed in the outer blanket only. If the canvas backing is exposed as a result of the formation of the recessed portion, the canvas may be sealed in the manner described above.

Generally, copies produced by web fed printing machines have columns of non-printed areas e.g. the central spine of a newspaper or the edges of the copy. The recessed portion in the blanket may be arranged so that it registers with the non-printing areas of the plate corresponding to these columns.

In the case where the printing plate is other than a grained plate, (e.g. where it is a grainless aluminium plate or a multi-metal plate) the amount of light reflected would be such as to "blind" the damp measuring device. In such a case therefore, the monitoring zone is preferably etched in order to provide a surface which will reflect light of the character required by the damp measuring device. Alternatively, a patch of suitably reflective material may be affixed to the plate to constitute the monitoring zone. The techniques of etching the monitoring zone or of affixing a suitable patch can, of course, also be used in conjunction with lightly grained plates, if desired.

For a better understanding of the invention and to show how the same may be carried into effect, reference will now be made, by way of example, to the accompanying drawings, in which.

Figure 1:
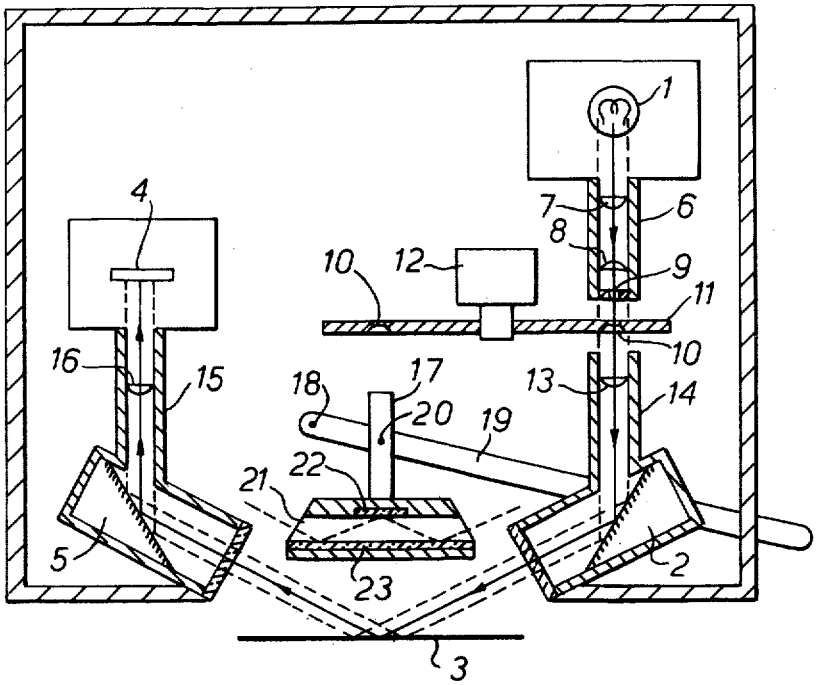
FIG. 1 shows schematically the measuring head of a damp measuring device forming a part of a printing machine of the present invention.

A damp measuring device and the associated circuitry as shown in the drawings are described in our U.S. Pat. application Ser. No. 274,653 now abandoned.

FIG. 1 diagrammatically shows a measuring head of a device for measuring the wetness of a printing plate. The head comprises a light source 1 arranged to direct a beam of light on to a mirror 2 which reflects the light on to a monitoring zone 3 constituted by a part of the non-printing area of a printing plate e.g. a grained aluminium printing plate on a plate cylinder. The device also includes a detector 4 to receive light reflected from the zone 3 via a second mirror 5. The light from the source 1 passes through a tube 6 containing a collimating lens 7 and a lens 8 which focuses the light onto an aperture 9. The light passes from the aperture 9 through apertures 10 in a chopper disc 11 driven by an electric motor 12 so that the light is transmitted from the chopper disc at the frequency of 100 c/s. The chopped light transmitted by the disc 11 then passes through a lens 13 in a tube 14 before striking the mirror 2. Light reflected from the zone 3 strikes the mirror 5 and then enters the detector 4 via a tube 15 containing a focusing lens 16. The light source 1 is a quartz halogen 12 volt 55 watt bulb. The detector 4 may be coupled to a circuit responsive substantially only to the alternating component of the signal produced by the detector 4 to discriminate against any stray light. Moreover, filters may optionally be incorporated into the chopper disc 11 so that distinct bands of radiation can be discriminated against if desired. The lens 13 focuses light on to the zone 3 to restrict the size of the light spot on the zone 3. This restricts the amount of scattered light which will reach the detector 4. The tube 15 also eliminates much of the scattered light. In this embodiment, it is important that directly reflected light, rather than diffusely scattered light, is detected by the detector 4. The mirrors 2 and 5 enable the profile presented by the device to the printing plate to be kept small while still directing light on to the printing surface at an optimum angle of incidence.

A standard is also provided for the measurement, and in one case this can be achieved by reflecting light from the zone 3 when dry, thereby to obtain the response of the device to a dry surface for comparison with the results for a wet surface. FIG. 1 shows how another form of standard may be provided. The standard is defined by a member 17 mounted for vertical movement, achieved by rotating about a fixed axis 18 a lever 19 pivoted to the member 17 at 20. The member 17 comprises a passage 21 to intercept the light from mirror 2 when the member 17 has been lowered. The opposite walls of the passage have glass plates 22 and 23 arranged so that light from mirror 2 will strike plate 23 twice and plate 22 once. The three reflections give a reflectivity corresponding to a certain, standard, amount of wetness. The path of light through the passage 21 when the member 17 has been lowered is illustrated in FIG. 1 by dashed lines.

In use of the device the member 17 is lowered and light is shone from the light source 1 to the detector 4 via the tube 6, lenses 7 and 8, chopper disc 11, lens 13, mirrors 2, 22, 23 and 5, and lens 16. The reflected chopped light received by the detector produces a first signal as hereafter described. The member 17 is then raised and the device is then used to detect reflected light from the zone 3 wet with water. The light reflected by the zone 3 into the detector 4 produces a second signal as hereafter described. A comparison of the first and second signals gives a measure of the amount of water present in the zone 3.

Figure 2:
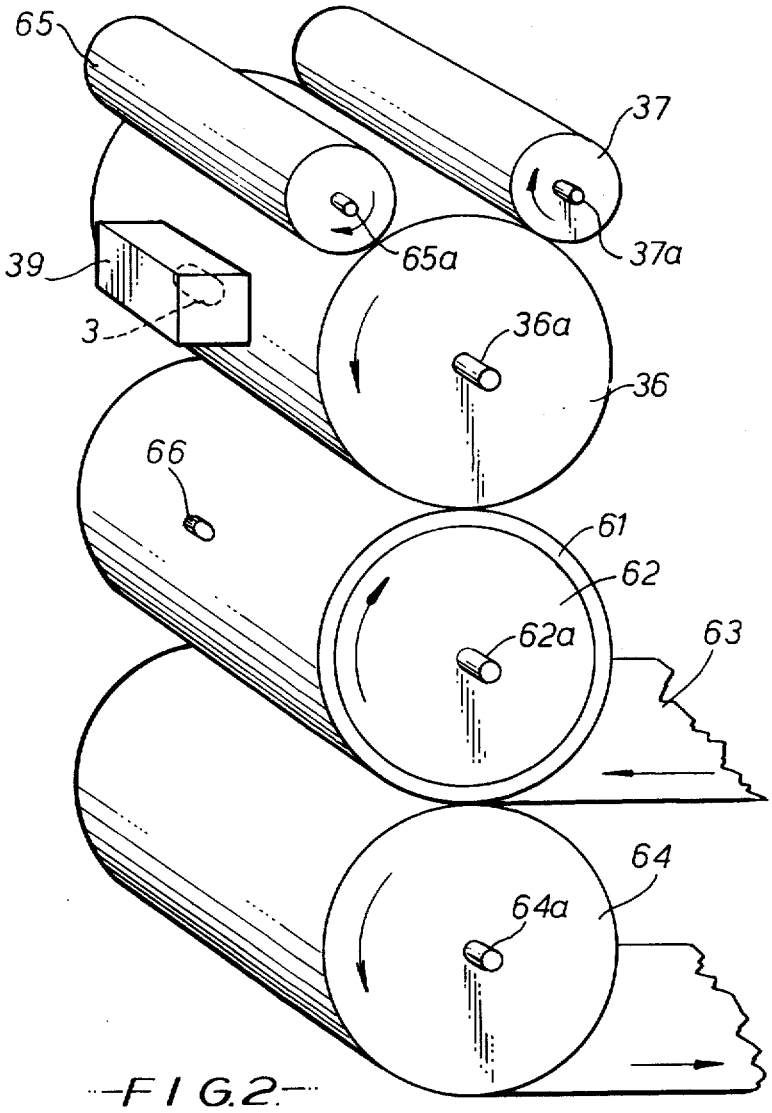
FIG. 2 is a schematic perspective view of one embodiment of a printing machine of the present invention incorporating the device of FIG. 1.
Figure 3:
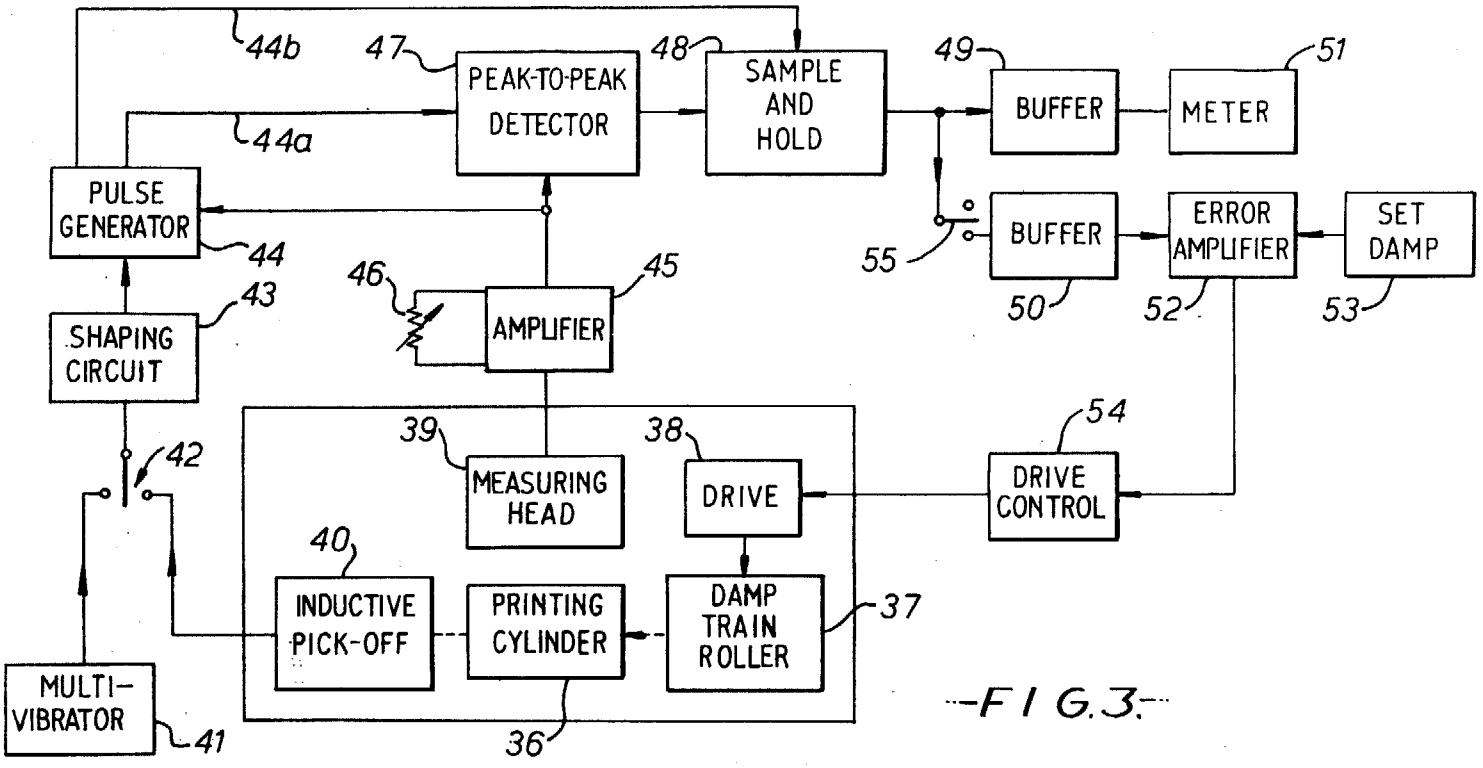
FIG. 3 shows a block diagram of part of the printing machine of FIG. 2.

Referring to FIGS. 2 and 3, the lithographic printing machine comprises a driven plate or printing cylinder 36 carrying a lithographic printing plate and mounted for rotation about axis **36*a*. When printing, the plate on the plate cylinder 36 is in contact with the offset blanket 61 of a blanket cylinder 62 mounted for rotation about axis 62*a*. The blanket 61 is in contact with a receiving member in the form of paper 63 carried by a cylinder 64 mounted for rotation about axis 64*a***.

The machine includes a means of applying water in the form of aqueous fountain solution to the printing plate. This could be in the form of a spray mechanism but, in this embodiment comprises a train of rollers which terminates in a damping roller 37 in contact with the printing plate and mounted for rotation about axis **37*a*. A roller of the damp train is driven by a variable speed drive 38 associated with a control unit 54** therefor.

The machine also includes a means of applying ink to the wetted printing plate. This comprises an inking roller 65 mounted for rotation about axis **65*a*. The inking roller 65** is in contact with the printing plate and is fed with ink by a train of rollers (not shown).

The axis of rotation of the rollers and cylinders 36, 27, 62, 64, and 65 are parallel and the direction of rotation is shown by the arrows.

The blanket 61 includes in its surface a recessed portion 66. This may be produced by deforming the blanket beyond its elastic limit but, in this embodiment is formed by removing a part of the rubber of the blanket. The location of the recessed portion on the outer surface of the blanket and the location of the printing plate on the cylinder 36 are so arranged that the recessed portion is in registry with a part of the non-printing area of the plate when at the nip between the plate cylinder 36 and the blanket cylinder 62. This part of the non-printing area constitutes the monitoring zone 3 and is shown as a dotted line in FIG. 2.

The machine includes a damp measuring device as described in FIG. 1 and the measuring head of this device is denoted by reference number 39. The measuring head is mounted so that monitoring zone 3 passes underneath the measuring head. Moreover, the device is operated in a manner such that it determines the amount of damp present on the monitoring zone 3. More particularly, the damp measuring device includes a pre-amplifier for the ouput of the detector, and an inductive pick-off 40 adapted to produce a pulse at a predetermined angular position of the cylinder 36. The arrangement is such that the pulse occurs when the monitoring zone 3 is below the measuring head 39. When the cylinder 36 is stationary, the pulse from the pick-up can be simulated by a 10 Hz multivibrator 41. A switch 42 is provided for manual selection of the output of multivibrator 41 or pick-off 40.

The pulses from switch 42 are supplied via a pulse shaping and limiting circuit 43 to a pulse generator 44 which is also connected to receive a signal from an amplifier 45. The amplifier 45 is an inverting amplifier having a variable gain determined by a variable resistance 46 and it receives a signal from the measuring head which is a representation of the light received by the detector of the measuring head.

The pulse generator 44 has first output **44*a* connected to a peak-to-peak detector 47 and a second output 44*b* connected to a sample-and-hold circuit 48. The first output 44*a* delivers a signal to energise the detector 47 for approximately one cycle of the output signal of amplifier 45, when a pulse has been received from switch 42. The second output 44*b* delivers a sampling pulse near the trailing edge of the energising signal at output 44*a* to cause the sample-and-hold circuit 48** to accept and store the detected value then existing.

In fact, the detector 47 comprises a positive peak detector and a negative peak detector combined so that the negative peak detector forms the sum of the positive-going peak and the negative-going peak. The circuitry of such a detector is to be found in "Electronic Engineering" of July, 1971, pages 63 and 64.

The sample-and-hold circuit 48 is constructed on the basis of the circuitry shown in the magazine "Orbit", Vol. 4, No. 7, September, 1969, page 58 of the English Edition published by Orbit Publishing — S.A.

The output signal of the circuit 48 is fed to two high-input, low-output, impedance unity gain buffer amplifiers 49 and 50. Buffer amplifier 49 feeds a moving-coil meter 51 to give a visual indication of the amount of wetness. Buffer amplifier 50 feeds its output as an "actual value" to a wetness control system which may be of conventional form.

This control system has an error amplifier 52 connected to receive the actual value from amplifier 50 and a "desired value" from a reference voltage source 53. The output of the amplifier 52, representing the error in wetness, is supplied to the controlled rectifier control unit 54 for controlling the drive 38 in a manner such that the amount of water applied to the plate by the damping roller 37 tends towards the desired value of wetness.

When the device 17 is operative, the resistance 46 is adjusted to give a predetermined indication at the meter 51. When the device 17 is withdrawn, the deflections at the meter provide a measure of the surface wetness according to a scale calibrated in terms of the standard defined by device 17. Effectively, therefore, any meter deflection from the predetermined indication represents the difference between the wetness of the surface of the printing plate and the standard wetness.

Moreover, the signal supplied by amplifier 50 to the control system will be dependent on the wetness of the printing plate but not substantially on long term variations in the strength of the source 1 and the sensitivity of the detector 4 as this signal will intermittently have a reference level set by use of the device 17 and the resistance 46. The effect is of a comparison between the amounts of light reflected by the standard and by the wet surface to produce a signal substantially only dependent upon the surface wetness and with a reference level dependent upon the standard.

FIG. 3 also shows a switch 55 enabling the wetness control system to be disconnected during use of the standard and enabling the values of wetness found immediately before use of the standard to be retained in the system for use when the control system is next brought into operation. For this purpose a capacitor of the circuit 48 for storing the values for amplifier 50 is connected downstream of the switch 55.

Figure 4:
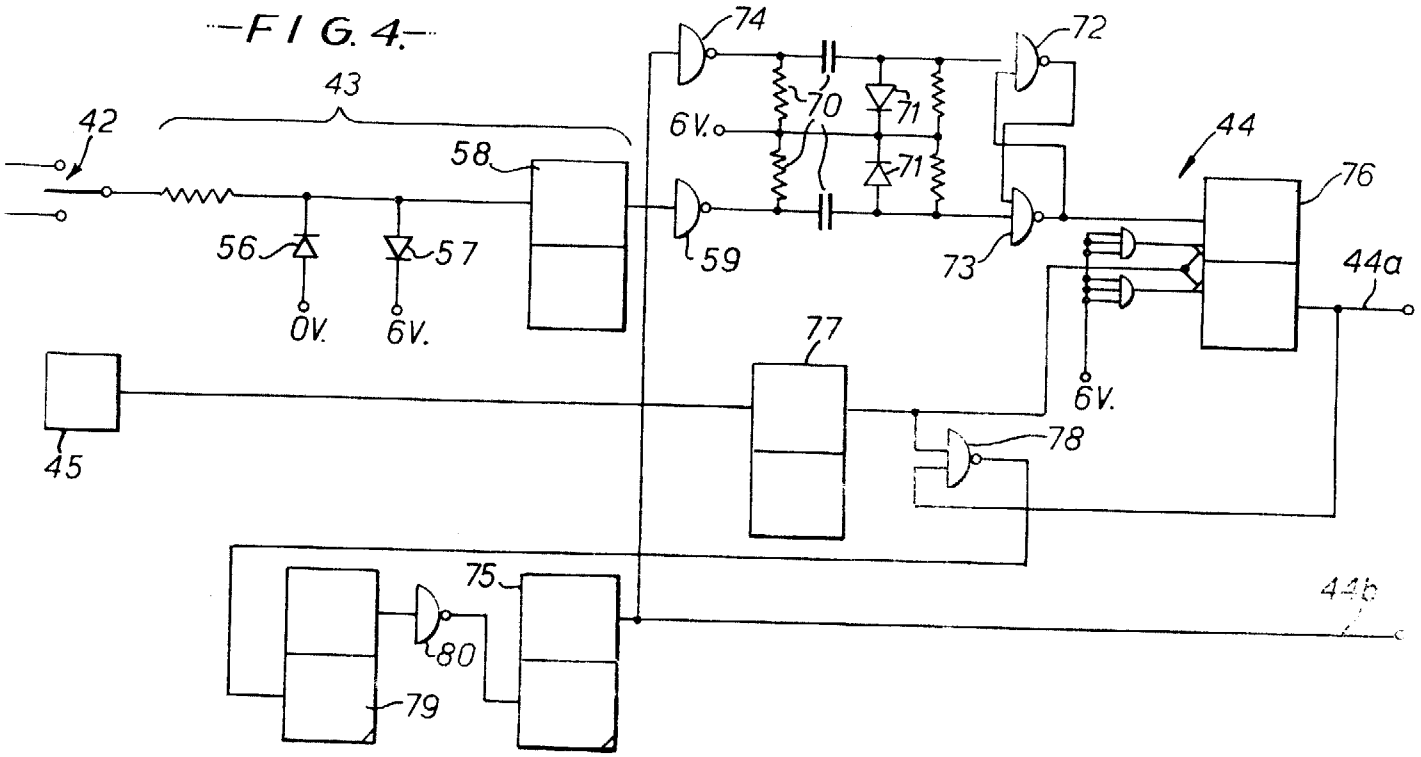
FIG. 4 shows in more detail a part of the circuitry of the machine of FIG. 3.

FIG. 4 is a circuit diagram of the shaping circuit 43 and that of generator 44.

The shaping circuit 43 comprises limiting diodes 56 and 57 and shaping means in the form of a Schmitt trigger circuit 58. The output of the trigger circuit 58 is connected via a NAND gate 59, differentiating means 70 and a limiting diode 71, to an R-S bistable circuit formed of cross-coupled NAND gates 72 and 73. Gate 59 is connected to one input of the circuit 72, 73 and a NAND gate 74 is connected to the other input, the NAND gate 74 receiving the sampling pulse from a monostable circuit 75 having a period of 50 $\mu$ seconds.

One output of the bistable circuit 72, 73 is connected to the J input of a J-K bistable circuit 76 having a trigger input connected to the output of a Schmitt trigger circuit 77 for shaping the pulses from amplifier 45. The output of the Schmitt trigger circuit 77 and the output **44*a* are connected by a NAND gate 78 to a monostable circuit 79 of peroid of 190 $\mu$ seconds. Circuit 79 is connected to circuit 75 by a NAND gate 80**.

In operation, a pulse from switch 42 sets the output signal of bistable circuit 72, 73 to a high level whilst a sampling pulse from monostable circuit 75 resets that output signal to a low level. This high level signal is supplied to the J input of the bistable circuit 76, which receives at its trigger input a squared form of the signal from the amplifier 45. The circuit 76 can only change its output signal at line **44*a* to a high level in response to the high level output signal from circuit 72, 73 at a negative going edge of the signal at the trigger input. It is in fact arranged for the signal on line 44*a* to go high on the first positive-going flank of the signal from the detector 4 once a pulse has been received from the switch 42. When the output signal of the trigger circuit 77 next goes high (on the next flank of the signal from the detector 4) NAND gate 78 produces a low level signal which causes the monostable circuit 79 to produce a 190 $\mu$ second pulse at the end of which the sampling pulse is produced by monostable circuit 75 to reset the bistable circuits 72, 73 and 76 and thus reduce the output signal on line 44*a*** to a low level.

The result is, as described above, a pulse on line **44*a*, commencing when a pulse has been passed by switch 42 and of a duration encompassing two adjacent peaks of the signal from the detector 4, and a sampling pulse on line 44***b* at the trailing edge of the pulse on line 44*a*.

In use, water is applied to the non-printing areas (including the monitoring zone 3) of the printing plate by the damping roller 37 and ink is applied to the printing areas of the printing plate by the inking roller 65. The ink on the printing area is transferred to the paper 63 by the blanket 61 of the blanket cylinder. The amount of water present on the monitoring zone 3 is determined by the damp measuring device and the amount of water subsequently applied to the printing plate by the damping roller 37 is controlled via the control unit 54 and the drive 38 in dependence on the amount determined as being present by the device having regard to the amount which is desired to be present. Since the monitoring zone 3 is in registry with the recessed portion 66 of the blanket when at the nip between the plate cylinder 36 and blanket cylinder 62, the monitoring zone 3 is not contacted by the blanket and hence is subjected to less wear. Thus, the readings of the damp measuring device are less susceptible to error due to variation as a consequence of wear during the course of printing.

In the apparatus shown in the drawings, the light directly reflected from the monitoring zone 3 is examined by the detector. If desired, however, the apparatus could be used to examine the light irregularly reflected (i.e. scattered) by the monitoring zone 3 in order to obtain a similar measure of the amount of liquid present on the printing surface. In effect, this technique is the inverse of the technique used in the apparatus shown in the drawings, in that, with a large amount of dampness, substantially no light would be detected.

Further, although the invention hereinabove described utilises a damp measuring technique involving the determination of the amount of radiation reflected by the zone due to the effects of scattering, it will be appreciated that any desired technique for measuring the amount of fountain solution present on the monitoring zone may be used. For example the damp measuring technique may involve the determination of the amount of radiation absorbed by the damp film on the zone or the determination of the electrical resistance of the zone as described in our copending U.S. Pat. application Ser. No. 396,244 now U.S. Pat. No. 3,916,789. As a generality, however, the present invention is particularly advantageous in conjunction with those damp measuring techniques whose accuracy is likely to be affected by wear, during printing, of that part of the printing plate being monitored.

I claim:

1. A method of determining the amount of water present on the surface of a printing plate carried by a plate cylinder during offset lithographic printing, which method comprises:

a. applying water to the non-printing area of the printing plate, b. applying ink to the printing area of the printing plate, c. transferring ink from the printing area to an offset blanket which is carried by a blanket cylinder and which includes a recessed portion in its surface, said recessed portion being arranged to be in registry with a part of the non-printing area of the printing plate when at the nip between the plate cylinder and the blanket cylinder, d. transferring ink from the blanket to a receiving member to be printed, and e. determining the amount of water present on a monitoring zone constituted by said part of the non-printing area.

2. A method according to claim 1 wherein the amount of water present on the monitoring zone is determined by directing radiation from a source to a detector by way of a standard medium which determines the proportion of said radiation reaching the detector to produce a first signal representing the amount of said radiation reaching said detector by way of the standard medium, directing radiation from said source at a given angle of incidence onto the monitoring zone so that radiation is reflected by said zone to said detector to produce a second signal representing the amount of radiation reflected from the zone, and making a comparison of the first and second signals to obtain a measure of the amount of water present on said zone.

3. An offset lithographic printing machine which comprises:

i. a plate cylinder carrying a printing plate including printing and non-printing areas, ii. a means of applying water to the non-printing area, iii. a means of applying ink to the printing area, iv. a blanket cylinder carrying an offset blanket which includes a recessed portion in its surface and which is arranged to receive ink from the printing area and transfer the same to a receiving member to be printed, said recessed portion of the blanket being arranged to be in registry with a part of the non-printing area when at the nip between the blanket cylinder and the plate cylinder, and v. a damp measuring device arranged to determine the amount of water present on a monitoring zone which is constituted by said part of the non-printing area.

4. A printing machine as claimed in claim 3, wherein said recessed portion is constituted by a hole extending through the blanket.

5. A printing machine as claimed in claim 3, wherein the blanket comprises a layer of rubber provided with a canvas backing and said recessed portion is constituted by a pocket gouged in said layer.

6. A printing machine as claimed in claim 5, wherein said pocket does not extend to the canvas backing.

7. A printing machine as claimed in claim 3, wherein the recessed portion is treated with a resinous material.

8. A printing machine as claimed in claim 3, wherein the recessed portion is in the form of a depression in the blanket.

9. A printing machine as claimed in claim 3, wherein the printing plate is a grained plate.

10. A printing machine as claimed in claim 3, wherein the printing plate is a grainless plate having an etched area constituting the monitoring zone.

11. A printing machine as claimed in claim 3, wherein said monitoring zone is constituted by a patch of material affixed to the printing plate.

12. A printing machine as claimed in claim 3, wherein the damp measuring device comprises a means of directing radiation at a given angle of incidence onto the monitoring zone and a means of detecting the amount of radiation reflected by said zone in a particular direction to provide a signal which represents the amount of water present on said zone.

13. A printing machine as claimed in claim 3, wherein the damp measuring device comprises a means of directing radiation onto the monitoring zone and a means of detecting the amount of radiation absorbed by the water on the zone to provide a signal which represents the amount of water present on the zone.

* * * * *